United States Patent [19]

Wenmaekers et al.

[11] Patent Number: 5,073,031

[45] Date of Patent: Dec. 17, 1991

[54] CONTINUOUS MANUFACTURE OF AN EMULSION IN DISCRETE QUANTITIES

[76] Inventors: Monique Wenmaekers, 22bis Avenue de Suffren; Wenmaekers Edmond, 2, 4 Avenue P. Déroulède; Paul Wenmaekers, 22bis Avenue de Suffren, all of 75015 Paris, France

[21] Appl. No.: 358,683

[22] Filed: May 30, 1989

[30] Foreign Application Priority Data

May 31, 1988 [FR] France ..... 88 07221

[51] Int. Cl.[5] ..... B01F 15/06; B01F 15/04

[52] U.S. Cl. ..... 366/144; 366/160

[58] Field of Search ..... 366/160, 161, 162, 152, 366/16, 18, 19, 144, 145, 146, 147, 148, 149, 22, 23, 24

[56] References Cited

U.S. PATENT DOCUMENTS

| | | | |
|---|---|---|---|
| 3,516,431 | 6/1970 | Sundt . | |
| 4,514,094 | 4/1985 | Buckholz | 366/160 |
| 4,593,928 | 7/1971 | Friedland | 241/34 |
| 4,850,703 | 7/1989 | Hanaoka | 366/160 |

FOREIGN PATENT DOCUMENTS

| | | |
|---|---|---|
| 0728203 | 10/1969 | Belgium . |
| 0163037 | 3/1985 | European Pat. Off. . |
| 1139677 | 2/1957 | France . |
| 1073886 | 6/1967 | United Kingdom . |

*Primary Examiner*—Robert W. Jenkins

[57] ABSTRACT

The invention relates to a device for the continuous manufacture of an emulsion.

The device comprises melters (1, 2) for bringing the components to the liquid state to form the emulsion. A metering melter (5) is provided to ensure the measuring out of the components of the emulsion in a mass proportion. This metering melter comprises a vessel (60) coupled to an electronic balance (7), the metering melter being connected to an emulsion vessel (6) by a pipework (51). Elementary metering feeding means (8) of different flow rates are provided, each being connected by a pipework (80) in its upper part to the melter (1, 2) permitting the components to be brought to the liquid state. The metering elementary feeding means (8) are also fed in their lower part with a floating fluid by means of a feeding circuit (19) making it possible to ensure the feeding of the metering melter with a component by overflowing when commanded by the change in the floating level of the components.

Applications to the manufacture of alimentary, pharmaceutical or cosmetological emulsions.

13 Claims, 3 Drawing Sheets

To cocktail stock
water. Alginate-preserving agent-
Perfume
Heating return
Heating
water exit

CONTINUOUS MANUFACTURE OF AN EMULSION IN DISCRETE QUANTITIES

The present invention relates to a device for the continuous manufacture of an emulsion in discrete quantities.

The production of emulsions of alimentary or pharmaceutical or cosmetic type on an industrial scale presents considerable problems of management of the production and storage facilities for the products obtained.

A process and a device for the continuous manufacture of an emulsion has been previously proposed by a European Patent Application No. 0,195,695 published on Sept. 24, 1986 in the name of Paul Wenmaekers. From the standpoint of operation, while a good precision of metering out is obtained in the abovementioned patent application, errors in metering out, also called different shot errors, appear between the various emulsion runs. According to the proposed solution, these errors are restored to an acceptable value by means of a continually full buffer vessel. However, this acceptable solution presents the disadvantage of requiring the presence of a hardware which is considerable and demanding, both from the standpoint of use and that of maintenance.

More recently, in a European Patent Application No. 88/400,069.6, filed on Jan. 14, 1988 in the name of Paul Wenmaekers, a metering melter was proposed, the bottom of which is filled with hot water, it being possible for the water level to vary so as to pour out the waxes or oils by overflowing relative to a constant level.

This system is wholly satisfactory from the standpoint of operation. However, it appears economically viable only for large-volume production, since it requires one melter-type unit per wax or oil to be measured out.

When the equipment described previously is employed for the production of a highly complex pharmaceutical or cosmetic emulsion designated under the trade name "Biafine", 85 liters of liquid paraffin, but only 12.5 liters of avocado oil and 18.5 liters of perhydrosqualene, must be employed for a run of one tonne of emulsion.

The proportion is even more marked in the case of the waxes employed, with 68 liters of glycol monostearate against 4.375 liters of cetyl palmitate.

The equipment described previously makes it possible, in the course of 24 days, continuous production, three 8-hour shifts, to ensure the total production of one year's consumption of Biafine on the world scale. The Biafine packaging lines can accommodate such a rate, but the problem of storing Biafine beyond two years then arises.

Thus, the equipment described previously operates perfectly, but its production efficiency is nil during its idle period. Furthermore, during the production of Biafine by means of the abovementioned equipment, mixtures such as calcium alginate + water + preserving agents + perfumes pass through the metering melter and its heating, in order to be metered out, and this presents the disadvantage of reducing the activity of the perfumes and of the preserving agents. Similarly, the production of Biafine with the aid of the prior equipment after heating the drums of triethanolamine, a 100% dilution of the latter is performed before it passes through the metering melter with an electronic balance. Lastly, the four waxes employed in the manufacture of Biafine are merely weighed in a proportion of Q.S. six tonnes, placed in a melter which is brought into operation for each run.

As precise as they may be, these preparatory weighings are not, in the eyes of the authorities of the Inspection of the Pharmaceutical Products, as reliable as those of the metering melter with an electronic balance, since triethanolamine is considered to be highly allergenic in quantities slightly exceeding the standards.

The objective of the present invention is to remedy the abovementioned disadvantages by the use of a device for the continuous manufacture of an emulsion retaining the same production capacity of one tonne/hour of an emulsion of the Biafine type, but in discrete quantities which can go up to 500 kg.

Another objective of the present invention is the use of a device for continuous manufacture, in which all the weighings involved in metering out, including the minidosages such as cetyl palmitate, at 2.18 liters, and pure triethanolamine for 500 kg are performed by passing through the metering melter with an electronic balance, so that the results displayed by the electronic balance take into account, after signing by the responsible pharmacist, the physicochemical analysis of the final product, analysis of this type being otherwise imposed and very demanding.

The device for the continuous manufacture of an emulsion containing, in a first liquid, a plurality of components in suspension, comprises means forming melters for bringing the components into the liquid state, so as to form a plurality of second liquids capable of being introduced into the first liquid, means permitting a determined quantity of the first liquid to be brought to the emulsion temperature, a metering melter making it possible to receive the said components in a liquid form and the first liquid in a mass proportion, the said metering melter being additionally capable of bringing its contents to the emulsion temperature and an emulsion vessel capable of receiving the said quantity of the first liquid and the contents of the said metering melter, the said emulsion vessel being equipped with appropriate means capable of producing the emulsion. It is noteworthy in that the said metering melter comprises a main vessel coupled with an electronic balance, the main vessel being connected via a connecting pipework to the emulsion vessel, and means for feeding second liquids to the metering melter. The means for feeding second liquids to the metering melter consists of a plurality of elementary feeding means metering a different flow, each of the said elementary feeding means being connected, at their upper part, to means for bringing the components into the liquid state so as to form a plurality of second liquids. Means for feeding the metering elementary feeding means are provided, in the lower part of the latter, with a fluid for floating the second liquids, these means for feeding the floating fluid making it possible to ensure the feeding of the said metering melter with second liquids by overflowing when commanded by the change in the floating level of the second liquids.

The device of the invention finds application in the production of alimentary, pharmaceutical or cosmetic emulsions on the industrial scale.

The invention will be understood better on reading the description and on inspecting the drawings which follow, in which:

FIG. 3(*a*) shows, in cross-section, a view of a melter capable of being employed in the equipment according to the invention, shown in FIG. 1, and FIG. (3*b*) a top view of FIG. 3(*a*);

Figure 4A:
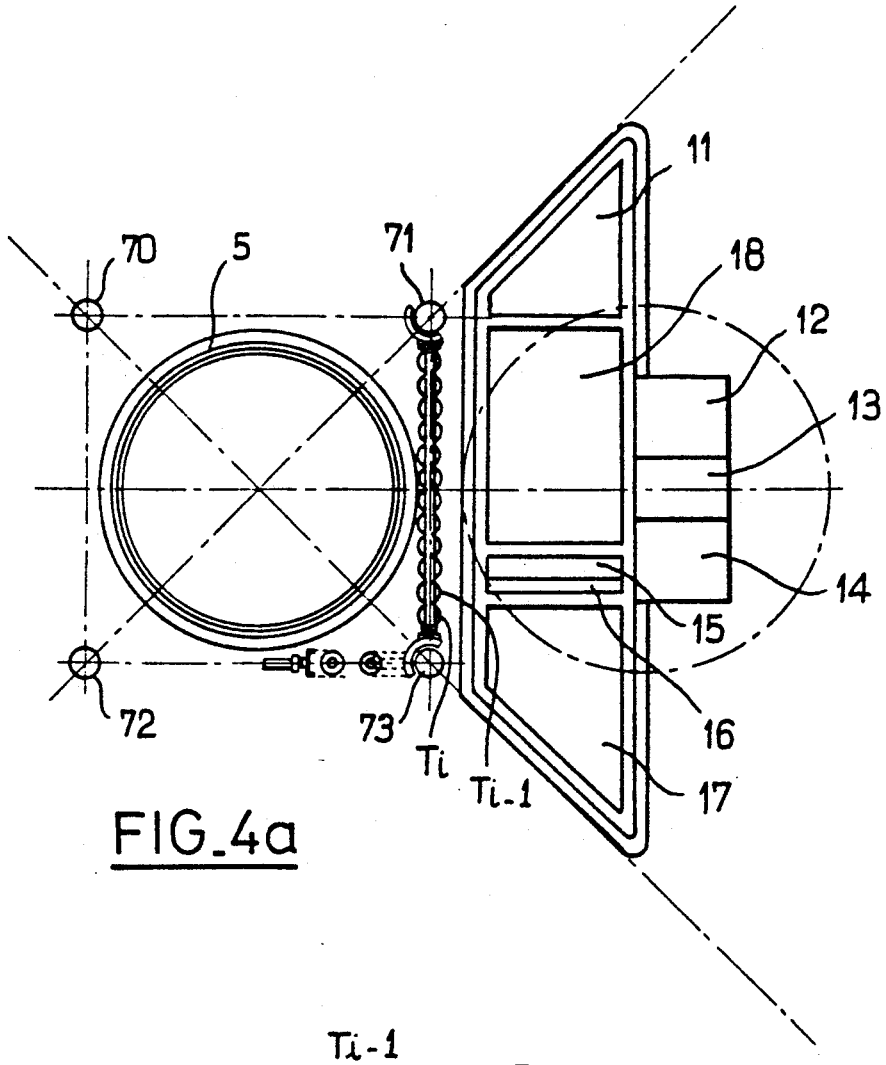
Figure 4B:
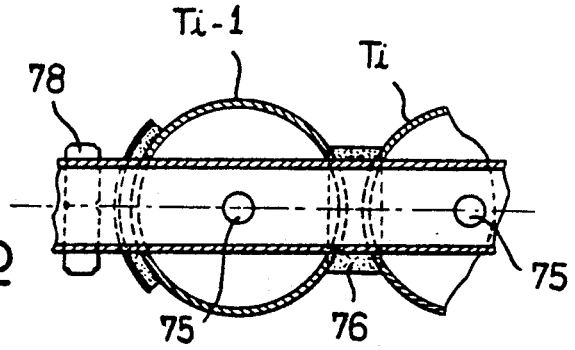
Figure 4C:
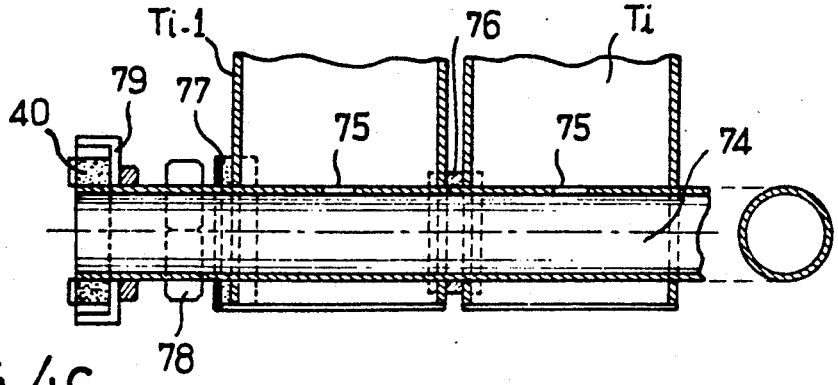

FIGS. 4(*a*), 4(*b*), 4(*c*) and 5 show a detail of embodiment of the melters and of the equipment of the device forming the subject matter of the invention in an advantageous embodiment, no limitation being implied.

Figures 1, 3A, 3B:
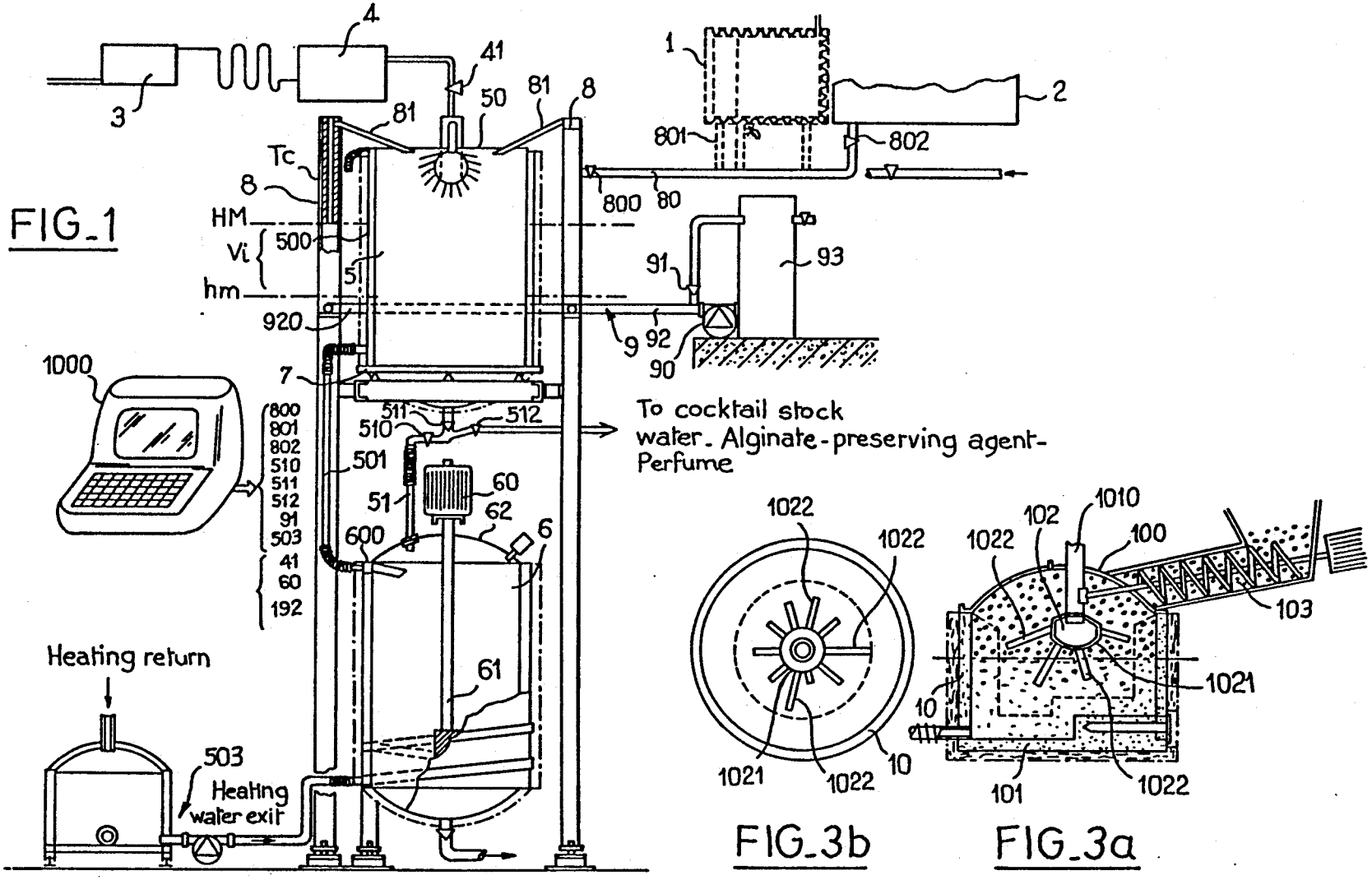
FIG. 1 shows a general view, in partial cross-section, of the device for the continuous manufacture of an emulsion in discrete quantities.

The device for the continuous manufacture of an emulsion in discrete quantities which forms the subject matter of the invention will first of all be described in conjunction with FIG. 1.

According to the abovementioned Figure, the device according to the invention permits the continuous manufacture of an emulsion containing a plurality of components in suspension in a first liquid. As represented in the abovementioned Figure, the device comprises means, marked 1 and 2, such as melters, which make it possible to bring the components into the liquid state or to a sufficiently fluid state so as to form a plurality of second liquids capable of being introduced into the first liquid. In addition, means 3 and 4 enable a determined quantity of the first liquid to be brought to emulsion temperature. These means may consist of a water heating system preceded by a system for deionizing the water, the first liquid consisting of water. For a more detailed description of an equipment which makes it possible to bring a determined quantity of the first liquid to the emulsion temperature, reference may advantageously be made to the description of the first European Patent Application referred to in the present Patent Application.

In addition, the device for the continuous manufacture of an emulsion forming the subject matter of the invention also comprises a metering melter, marked 5, making it possible to receive the components in a liquid form and the first liquid in a mass proportion. The metering melter 5 is additionally capable of bringing its contents to the emulsion temperature. An emulsion vessel 6 is capable of receiving the quantity of first liquid and the contents of the metering melter 5, this emulsion vessel 6 being equipped with suitable means, marked 60 and 61, capable of producing the required emulsion. For a more detailed description of the arrangement of the elements described previously, reference may advantageously be made to the description of the original Patent Application No. 0,195,695, mentioned previously. Naturally, and in a similar manner to the equipment described in the abovementioned Patent, the device forming the subject matter of the invention also comprises a calculator, for example of the microcomputer type, marked 1000, enabling the manufacturing process to be conducted, as will be described in greater detail later in the description.

According to a particularly advantageous feature of the device forming the subject matter of the invention, the metering melter 5 comprises a main vessel, marked 60, coupled with an electronic balance, marked 7. The main vessel is connected by a connecting pipework 51 to the emulsion vessel 6. Valves consisting, for example, of solenoid valves, marked 510, 511 and 512, may be advantageously provided in the pipework 51.

In a conventional manner, the metering melter 5 and the emulsion vessel 6 respectively comprise a heating circuit consisting of a jacket 500 and a coil 600 surrounding the metering melter 5 and the emulsion vessel 6 respectively, the two being connected by a pipework 501, the jacket and the coil connected by the pipework both carrying a heating fluid which may consist of heating water pressurised by a supply circuit marked 503. This last heating circuit will not be described in detail, because it corresponds to elements which are perfectly known in the corresponding technology.

As additionally shown in FIG. 1, the device forming the subject matter of the invention comprises means for feeding the metering melter 5 with a second liquid. These feeding means, marked 8, consist of a plurality of metering elementary feeding means of different flow rates. Each of the metering elementary feeding means 8 is connected by a pipework 80 in its upper part to the means 1 and 2 for bringing the components into the liquid state so as to form a plurality of second liquids. Naturally, by way of an example without any limitation being implied, FIG. 1 shows only two means, marked 1 and 2, for bringing the components into the liquid state, so as not to overload the drawings unnecessarily, it being possible for the device forming the subject matter of the invention to comprise a greater number of these means forming a melter, as will be described later in the description in a particular nonlimiting embodiment of the device forming the subject matter of the invention for the production of a pharmaceutical product of high quality marketed under the trademark "Biafine". The pipework 80 may comprise, for example, a valve 800 in the vicinity of the corresponding metering feeding means 8 and a valve or solenoid valve 802 in the vicinity of the melter marked 2, for example. In the same way, the corresponding valve or solenoid valve close to the melter marked 1 is marked 801.

In addition, means 9 for feeding the metering elementary feeding means 8 in the lower part of the latter with a fluid for floating the second liquids are provided. The means 9 for feeding a floating fluid make it possible to ensure the feeding of the metering melter 5 with a second liquid by overflowing when commanded by the change in the floating level of the abovementioned second liquids. As can be seen in FIG. 1, the upper end of the metering elementary feeding means 8 comprises a discharge pipe marked 81 which, obviously, opens into the metering melter 5. The means 9 for feeding the floating fluid, which may advantageously consist of water, may consist of a pressurizing pump 90, for example an electrical pump, connected, on the one hand, to a pipework 92 and to a water storage vessel 93 communicating with the pipework 92 by means of a bypass circuit 91. The pipework 92 allows the base of each metering elementary feed means 8 to be fed in parallel.

The general operating procedure of the device forming the subject matter of the invention and shown in FIG. 1 is the following. The melter such as 1 or 2 pours the component forming the second liquid, consisting of an oil, a wax or any material with a relative density lower than 1 and immiscible with water, over into at least one of the metering elementary feeding means 8 by means of the pipework 80 and of the valves 802 and 800. The metering melter 9 records the start of the weighing as soon as the abovementioned second liquid passes through one of the discharge pipes 81 described previously. When the weighing of the corresponding second liquids comes within 2 or 3% of the ideal mass required for this component for the emulsion run in question, the automatic valve or solenoid valve 800 is closed. This closing of the valve 800 starts up the pump 90 of the means for feeding the second liquid through the floating fluid and the initial level of the floating fluid marked hm in FIG. 1, surmounted, in one or more metering elementary feeding means 8, by the second liquid in question, rises in each of the metering elementary means 8 in question. The second liquid needed for the remainer of the metering out then pours over into the metering melter 5 which, through the intermediacy of the electronic balance 7, simultaneously commands the stopping of the pump 9 and the opening of the return valve 91 of the bypass of the floating fluid into its storage vessel 93 when the weighing set value is reached for the second liquid in question.

The ideal weighing is thus obtained.

The effect of the plurality of the metering elementary feeding means 8 is to change slightly the general level of the floating water, even if the relative density of the second liquid in question to be measured out is close to 1.

Naturally, in the case where the 2 or 3% of second liquid to be measured out cannot be contained in only one of the metering elementary feeding means 8, it is advantageous, in accordance with the device forming the subject matter of the invention, to employ several of these in the most suitable manner. The ideal weighing of the second liquid being thus obtained, and the metering melter 5 and the emulsion vessel 6 being advantageously mounted at superposed levels so as to ensure the gravity flow of the contents of the metering melter 5 into the emulsion vessel 6, the valves 511 and 510 are then opened, valve 512 being closed to ensure the flow of the component consisting of the second liquid into the emulsion vessel 6.

The process of manufacture can then, for example, be continued in accordance with the process of manufacture described in European Patent Application No. 0,195,695, mentioned previously in the introduction to the description.

The metering elementary feeding means 8 may advantageously consist of substantially vertical tubes marked Ti where i indicates the sequential number of a tube in question. These tubes are arranged at the periphery of the metering melter 5, each tube being equipped in its upper part with the discharge pipe 81 opening into the metering melter 5, as shown in FIG. 1. In addition, in the upper part of the tubes Ti, the latter are connected to the pipework 80 for connecting to the melter 1 or 2, it being possible for each tube Ti to be thus fed in parallel by each of the melters 1 or 2 by means of the pipework 80 and of a valve such as the valve 800 associated with each tube Ti.

According to a particularly advantageous embodiment, no limitation being implied, the tubes Ti are substantially vertical and each has a different internal cross-section, so as to define an elementary volume marked Vi which is different for each tube Ti, between the minimum level hm and a maximum level, marked HM, of the floating fluid. In this way, the device forming the subject matter of the invention makes it possible, by selectively commanding the solenoid valves 800, to ensure the feeding of a second liquid to a selection of the tubes Ti of different internal cross-sections, to ensure a remaining metering out of the second liquid corresponding to the sum of the elementary volumes Vi of the tubes Ti which have been fed with the abovementioned second liquid. Naturally, during the operating process, the sum of the volumes Vi will be taken equal or slightly greater than the remainer needed. This calculation can, of course, be performed by means of the calculator 1000 which, for a change in the level of the floating fluid between the minimum and the maximum levels hm and HM can then without any difficulty determine the sequence i and the tube Ti which are needed to form the total volume of second liquid needed for the remaining metering. In a particularly advantageous alternative form of the device forming the subject matter of the invention, each tube Ti can have, when compared with another tube marked Ti-1, a cross-section of Si, Si-1 respectively, in a ratio of 2, the corresponding elementary volume Vi, Vi-1 between the maximum and minimum levels HM and hm of the floating fluid being then in the same ratio of 2. The group of the tubes Ti forming the metering elementary means 8 then has cross-sections Si and elementary volumes Vi forming a geometric progression with a ratio of 2 to ensure a corresponding quantification of the total volume and of mass of the second liquid introduced into the metering melter. As a reminder, it will be recalled that such a way of distributing the volumes Vi, where Vi is of the form $V0.2^i$, where V0 denotes the smallest elementary volume for the application in question, makes it possible to quantify a total volume over the first i tubes equal to:

$$V = V0.(2^i - 1)$$

with a precision equal to not more than V0, the smallest elementary volume. Naturally, the mass corresponding to the volume thus quantified is obtained without difficulty by means of the microcomputer 1000, bearing in mind particularly the temperature and relative density conditions of the second liquid in question.

Thus, as shown advantageously in FIG. 1, the tubes Ti forming the metering elementary feeding means 8 can advantageously be mounted in solid supports forming a framework supporting the metering melter 5 and the emulsion vessel.

Figure 2:
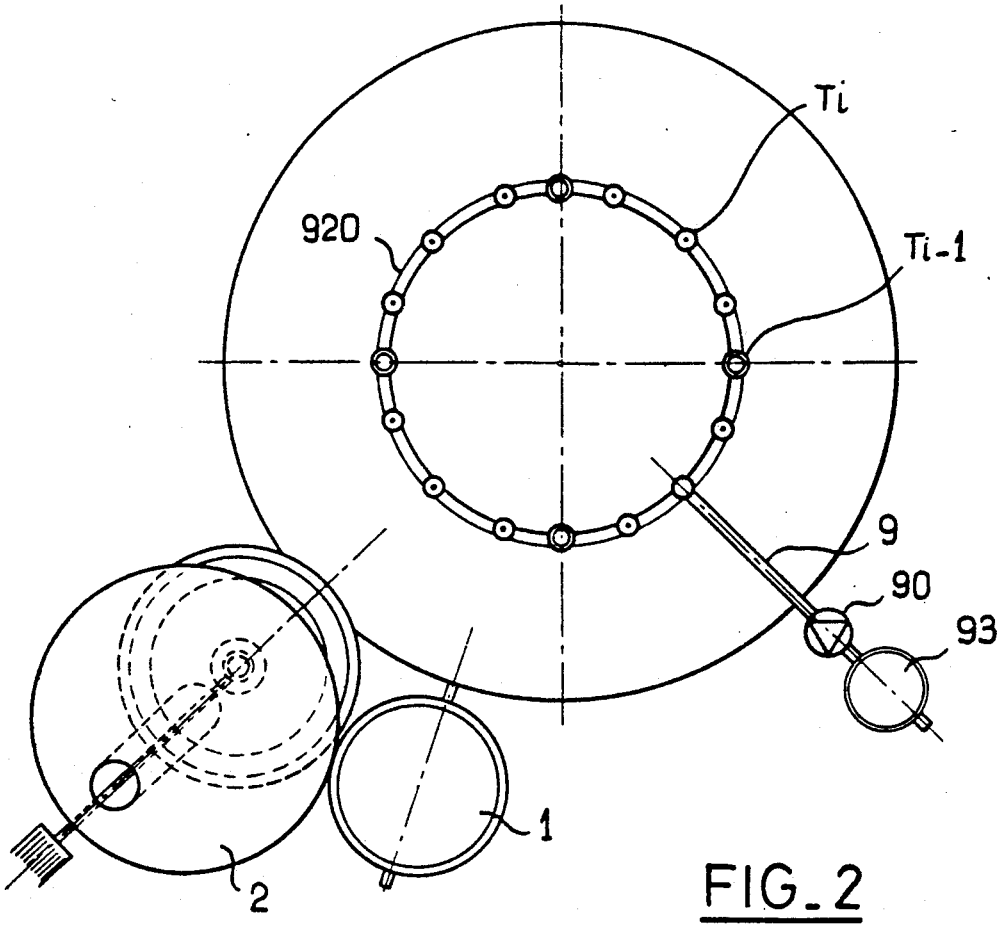
FIG. 2 shows a top view of a particular arrangement of FIG. 1.

As shown in FIG. 2, the solid supports, whether used merely as carriers or as solid supports forming a metering elementary feeding means can be distributed at the periphery of the metering melter according to, for example, a circular arrangement. This arrangement, or the form thereof, does not constitute a limit.

A more detailed description of the means 1 and 2 forming a melter will be given in a particularly advantageous nonlimiting embodiment in which the device forming the subject matter of the invention is intended more especially for the manufacture of a pharmaceutical emulsion of high quality.

In this case, each melter 1, 2, forming a melter for bringing the components into the liquid state so as to form a plurality of second liquids, may advantageously comprise a heating enclosure 10, itself connected to the heating circuit 503, for example, comprising, in the case of waxes, an entry hopper 100 fitted with a feed screw and a vibrator 103. Means 101 for heating the sidewalls of the heating enclosure are provided, it being possible for these means to consist of a jacket in which heating water delivered by the heating circuit 503 is circulated.

Lastly, means 102 for additional heating using pulsed air permit the thorough heating of each component.

The additional heating means 102 may advantageously comprise a central pipework 1020 permitting the introduction of pulsed hot air and a hot air distribution bowl 1021 connected to the end of the central pipework 1020 and placed in the center of the heating enclosure. Secondary pipeworks 1022 are connected to the distribution bowl and to the central pipework, the secondary pipeworks extending radially from the distribution bowl. A more detailed description of the abovementioned melters having been given, the device forming the subject matter of the invention may advantageously comprise buffer storage vessels for each abovementioned melter, with a view to optimising the process of heating of the second liquids, especially in the case of the production of Biafine. The buffer storage vessels are contiguous and adjacent and separated by hollow partitions permitting the heating fluid to circulate.

In the embodiment shown in FIG. 4, contiguous buffer storage vessels comprise a buffer storage vessel for liquid paraffin, marked 11, a buffer storage vessel for propanediol, marked 12, a buffer storage vessel for avocado oil, marked 13, a buffer storage vessel for perhydrosqualene, marked 14. One of the walls of the buffer storage vessels 12, 13 and 14 is used as an external wall for the circulation of the heating fluid and enables a gentle heating of the avocado oil to be ensured. In addition, the buffer storage vessels also comprise a buffer storage vessel for cetyl palmitate 16, a buffer storage vessel for stearic acid 17 and a buffer storage vessel for glycol stearate 18. This embodiment permits a saving in stainless steel for producing the buffer storage vessels, and, above all, the abovementioned gentle heating of the avocado oil, which lacks fluidity when it is at ambient temperature.

It is remarkable that the buffer storage vessels described in conjunction with FIG. 4 comprise only a single heating system for a unit comprising 8 components, 6 of which must be melted or heated; in particular, only one stock exists for the heating.

In an embodiment, the buffer storage vessels such as described in FIG. 4 have made it necessary to occupy a floor area of 1.09 $m^2$, whereas a single cylindrical vessel of the same volume and of the same height would occupy 1.13 $m^2$ for a single component. occupy In FIG. 4, the metering feeding means 8 consisting of the tube Ti have been shown, the tubes Ti being arranged with the benefit of a square distribution. In this embodiment, the carrier solid supports 70, 71, 72 and 73 are placed in the corner of the square arrangement, the abovementioned carrier solid supports being equipped with couplings marked 33, the tube 920 in FIG. 1 which ensures the feed of floating liquid to each tube Ti being replaced by tubes 74. These tubes 74 comprise as many perforations 75 as metering feeding means consisting of the tubes Ti. The latter are placed alongside each other, separated merely by a coupling 76. When all the tubes Ti are engaged, two reinforced-shell couplings 77 are then fitted and one of the two nuts 78 permitting the mounting of the whole to be ensured is tightened. Flanges 79 containing a coupling 40 are screwed onto the ends before being engaged and then bonded to the connection 73.

It is thus possible to effect one, two, three or four couplings and the mounting system thus described is quite evolutionary. For an external diameter of the tubes Ti of 70 mm it is possible to have available twelve tubes per side of the square arrangement with the possibility of forty eight accesses via the discharge pipes 81 to the metering melter 5 with the corresponding volume and mass quantification of second liquid.

In the case of the production of Biafine, one of the components used for the manufacture of an emulsion of this kind, namely triethanolamine, must be brought to emulsion temperature under special conditions.

Figure 5:
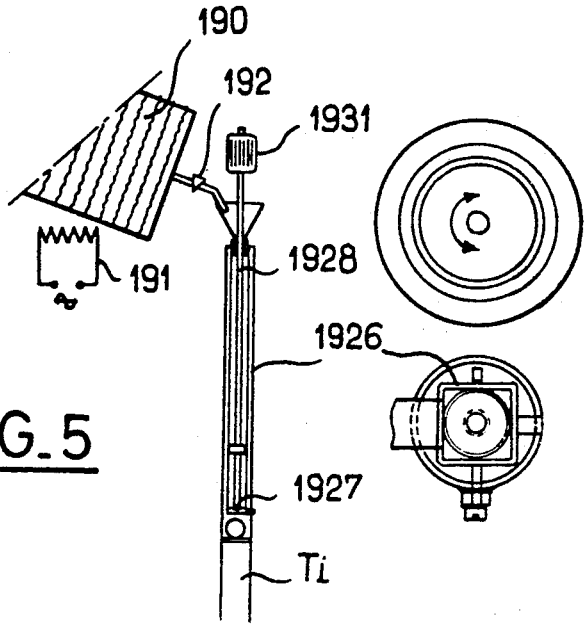

This component, with a relative density between 1.20 and 1.25 normally crystallizes at a temperature below 20° C. It is therefore advantageous, in accordance with the device forming the subject matter of the invention, to produce the triethanolamine melter in the way described below with FIG. 5.

According to the above mentioned Figure, the triethanolamine melter comprises a triethanolamine drum in which this component is normally packaged. It also comprises means of heating, marked 191, it being possible for these to consist of means of heating of a conventional type, the latter being shown diagrammatically in FIG. 5 as a heating resistor.

Furthermore, the triethanolamine melter 19 comprises a pump 192 comprising an internal tube 1926 of square cross-section, whose bottom is shut off at 1927. The inner tube communicates with one of the tubes Ti described previously in conjunction with FIG. 1 or FIG. 4*a*. A system for commanding the opening or the closing of the shutter 1927 of the square tube consists of a drive motor 1931 and an actuating rod 1928, and makes it possible to ensure the triethanolamine feed to the tube Ti in question.

A description has thus been given of a device for the continuous manufacture of an emulsion in discrete quantities which is particularly highly effective insofar as the device thus described permits the manufacture of emulsions, and especially of pharmaceutical or cosmetological emulsions with a remarkable precision of metering, this precision of metering making it possible simultaneously to ensure the physicochemical analysis of the emulsion thus obtained.

The device forming the subject matter of the invention is additionally remarkable in its mechanical design and its mode of operation. It will be noted that the fluid for floating the second liquids may advantageously consist of hot water, this water being preferably at the temperature of the liquid waxes or of the oils in order to ensure a good estimate of the quantities of components formed by the second liquids at the emulsion temperature. The use of a floating fluid at the emulsion temperature makes it possible to avoid the cooling of the second liquid before its introduction into the metering melter 5.

We claim:

1. A device for the continuous manufacture of an emulsion comprising, in a first liquid, a plurality of components in suspension, said device comprising means forming a first melter for bringing said components into the liquid state so as to form a plurality of second liquids, means bringing a determined quantity of said first liquid to emulsion temperature, a second melter in the form of a metering melter, said metering melter receiving the said components in liquid form and the first liquid in a mass proportion, said metering melter additionally bringing its contents to emulsion temperature, and an emulsion vessel receiving said quantity of the first liquid and the contents of said metering melter, said emulsion vessel being equipped with means producing the emulsion, in which said metering melter comprises:

a main vessel coupled with an electronic balance, said main vessel being connected by connecting pipework to said emulsion vessel;

means for feeding said metering melter with second liquids, said means of feeding consisting of a plurality of metering elementary feeding means of different flow rate, each of said elementary feeding means being linked in its upper part to said means for bringing said components to the liquid state so as to form a plurality of second liquids;

means for feeding said metering elementary feeding means, in the lower part of the latter, with a fluid for floating said second liquids, said means for feeding a floating fluid feeding said metering melter with second liquids by overflowing when commanded by the change in the floating level of said second liquids.

2. The device according to claim 1, wherein said metering melter and said emulsion vessel at superposed levels so as to ensure the gravity flow of the contents of the metering melter into the emulsion vessel.

3. The device according to claim 1, wherein said metering elementary feeding means consist of substantially vertical tubes arranged at the periphery of the metering melter, each tube being equipped with a discharge pipe opening into the metering melter.

4. The device according to claim 3, wherein each of the substantially vertical tubes has a different internal cross-section so as to define an elementary volume which is different for each tube, between the minimum level and the maximum level of the floating fluid.

5. The device according to claim 4, wherein each of the substantially vertical tubes has, in relation to another tube a cross-section in a ratio of 2, the corresponding elementary volume between the maximum and minimum levels of the floating fluid being in a ration of 2, the tubes thus having cross-sections and elementary volumes forming a geometric progression with a ratio of 2 to ensure a quantification of the total volume and of the mass of the second liquid introduced into the metering melter.

6. The device according to claim 3, wherein the tubes are mounted in solid supports forming a framework supporting the metering melter and the emulsion vessel.

7. The device according to claim 1, wherein each means forming a melter for bringing said components to the liquid state so as to form a plurality of second liquids comprises:

a heating enclosure comprising, in the case of waxes, an entry hopper with a vibrator;

means for heating the sidewalls of the heating enclosure;

means for additional heating, using pulsed air, to thoroughly heat each component.

8. The device according to claim 7, wherein the means for additional heating comprise:

a central pipework for introducing pulsed hot air;

a distribution bowl for hot air, connected to the end of the central pipework and placed in the center of the heating enclosure;

secondary pipeworks connected to said distribution bowl and to the central pipework, the secondary pipeworks extending radially from the distribution bowl.

9. The device according to claim 7, wherein, in order to optimize the process of heating the second liquids, said melters are equipped with contiguous adjacent buffer storage vessels separated by hollow partitions to circulate a heating fluid.

10. A device according to claim 9, wherein said contiguous buffer storage vessels comprise a buffer storage vessel for liquid paraffin, a buffer storage vessel for propanediol, a buffer storage vessel for avocado oil, a buffer storage vessel for perhydrosqualene, one of the walls of the buffer storage vessels serving as an external wall for the circulation of the heating fluid making it possible to ensure a gentle heating of the avocado oil, a buffer storage vessel for paraffin slabs, a buffer storage vessel for cetyl palmitate, a buffer storage vessel for stearic acid and a buffer storage vessel for glycol stearate.

11. The device according to claim 10, further including a triethanolamine melter which comprises:

a drum of triethanolamine;

means for heating the said drum;

a triethanolamine pump comprising an internal tube, the bottom of said internal tube being in communication with;

a substantially vertical tube equipped with a discharge pipe opening into the metering melter;

a shutter for selectively closing the bottom of said internal tube; and means for displacing the shutter of the internal tube so as to open or close the bottom of said internal tube.

12. The device according to claim 7, further including a triethanolamine melter which comprises:

a drum of triethanolamine;

means for heating the said drum;

a triethanolamine pump comprising an internal tube, the bottom of said internal tube being in communication with;

a substantially vertical tube equipped with a discharge pipe opening into the metering melter;

a shutter for selectively closing the bottom of said internal tube; and means for displacing the shutter of the internal tube so as to open or close the bottom of said internal tube.

13. The device according to claim 1, further including a triethanolamine melter which comprises:

a drum of triethanolamine;

means for heating said drum;

a triethanolamine pump comprising an internal tube, the bottom of said internal tube being in communication with;

a substantially vertical tube equipped with a discharge pipe opening into the metering melter;

a shutter for selectively closing the bottom of said internal tube; and means for displacing the shutter of the internal tube so as to open or close the bottom of said internal tube.

* * * * *